US005595095A

United States Patent [19]

Hillinger

[11] Patent Number: 5,595,095

[45] Date of Patent: Jan. 21, 1997

[54] RATCHETING SOCKET WRENCH WITH INTERMESHING GEARS

[76] Inventor: George Hillinger, 129 N. LeDoux Rd., Beverly Hills, Calif. 90211

[21] Appl. No.: 517,842

[22] Filed: Aug. 22, 1995

Related U.S. Application Data

[63] Continuation-in-part of Ser. No. 322,594, Oct. 13, 1994, abandoned.

[51] Int. Cl.[6] ..... B25B 13/00

[52] U.S. Cl. ..... 81/58.3; 81/60

[58] Field of Search ..... 81/58.3, 60–63.2

[56] References Cited

U.S. PATENT DOCUMENTS

| | | | |
|---|---|---|---|
| 145,399 | 12/1873 | Colbert | 81/58.3 |
| 2,300,479 | 11/1942 | Wilson | 81/60 |
| 4,939,961 | 7/1990 | Lee | 81/60 |
| 5,365,807 | 11/1994 | Darrah et al. | 81/60 |

*Primary Examiner*—James G. Smith
*Attorney, Agent, or Firm*—Albert O. Cota

[57] ABSTRACT

A reversible and a bidirectional ratcheting wrench that transfers multiple torque power from the handle to a nut, or a standard or special socket, by use of flat gears. The oscillating power, applied to the handle of the reversible ratchet wrench is transferred as a rotating motion to a flat gear rotating sleeve. The polygonal inside shape of the rotating sleeve is mounted on a nut or a special socket, completing the transfer of the torque power. The bidirectional wrench utilizes two pairs of gears to insure that each pair creates a different rotational direction of the wrench. A push-pull button mounted in the handle allows the switching from one pair of gears to the other, and from one rotating direction to the other

10 Claims, 8 Drawing Sheets

RATCHETING SOCKET WRENCH WITH INTERMESHING GEARS

CROSS REFERENCE TO RELATED APPLICATION

This application is a continuation-in-part of application Ser. No. 08/322,594 filed Oct. 13, 1994, now abandoned.

TECHNICAL FIELD

The present invention pertains to the general field of ratcheting socket wrenches and more particularly to wrenches that have multiple teeth for torque engagement and that do not require electrical or hydraulic power for their usage.

BACKGROUND ART

Ratchet wrenches have long been utilized to apply torque, to tighten or loosen a nut or bolt head. Socket wrenches were initially created to rotate the ratcheting head in only one direction. To use a socket wrench in the opposite direction, the ratcheting head had to be removed from the socket or nut, turned over, and reinserted over the socket or nut.

The improved and more complex wrench designs which followed included a device which allowed changing the direction of the ratcheting action without the need to remove the ratcheting head from the socket or nut. Usually, this is accomplished by turning a knob located on top of the ratcheting head, or pushing a knob located on the forward end of the handle.

Most prior art ratcheting wrenches with reverse capabilities employ a rotatable driver which operates a driving pawl with one to four teeth that engage the teeth of the driver. The rotating motion of the driver is transferred to the socket or nut in the desired direction. The reverse oscillation of the handle is transferred to the ratcheting motion of the driver, without engaging the socket or nut. This ratcheting mechanism also eliminates the need to turn the handle and the ratcheting head 180° to engage the socket or nut in the opposite direction. A disadvantage of socket wrenches that use a pawl is the limited torque transferred from the handle to the rotating head and subsequentially to the socket or nut. To increase the torque of this type of socket wrench it is necessary to use longer teeth on the drive head and a correspondingly larger pawl. This change increases the overall dimensions of the wrench, which is counter-productive to the utility thereof.

A search of the prior art did not disclose any patents that read directly on the claims of the instant invention, however the following U.S. patents are considered related:

| U.S. Pat. No. | INVENTOR | ISSUED |
|---|---|---|
| 5,152,196 | Garrett | 6 October 1992 |
| 5,095,781 | Blake et al | 17 March 1992 |
| 4,939,961 | Lee | 10 July 1990 |
| 4,602,534 | Moetteli | 19 July 1986 |
| 4,479,409 | Antonius | 30 October 1984 |
| 4,270,417 | Tesoro | 2 June 1981 |
| 2,697,370 | Brooks | 21 December 1954 |
| 1,494,513 | Stewart et al | 20 May 1924 |
| 145,399 | Colbert | 9 December 1873 |

The Garrett U.S. Pat. No. 5,152,196 discloses a ratchet wrench with an auxiliary ratcheting mechanism and a knob-like body. The auxiliary mechanism attaches to a ratchet wrench allowing a loose nut to be tightened by hand prior to using the wrench handle or when no space is available, to move the handle.

The Blake U.S. Pat. No. 5,095,781 discloses a ratchet spinner that is formed as a central aperture disc with a serrated peripheral edge. An integral segmented collar surrounds the aperture in the disc and protrudes axially with a number of flanges that fit into a ratchet wrench. The spinner may be manually rotated in order to ratchet the wrench to tighten the workpiece by hand before oscillating the handle.

The Lee U.S. Pat. No. 4,939,961 discloses a reversible wrench having a first gear face disc with a central square hole and a second gear face disc. The two disc's are meshed by depressing an undulated spring washer axially bound between the discs and the wrench body. A driving stud is positioned within the square hole of a second gear body. To change directions of the ratchet, the wrench must be removed, rotated 180° and reinserted into the socket or nut. The transfer of the oscillating power from the handle to the workpiece provides the power needed for a standard socket, however, the Lee design produces a wrench that:

a) requires a considerable number of moving parts, which reduces the transferred power, b) creates an added risk of mechanical breakdown, c) increases the manufacturing process and unit cost, d) has gear teeth that may "jump" over the engaged teeth because of insufficient spring pressure or too much ratcheting power, and e) allows only the use of standard sockets.

The Moetteli U.S. Pat. No. 4,602,534 discloses a pair of pawls that intersect internal ratchet teeth which are engaged by an annular reversing plate positioned above the pawls. The pawls are jammed between the teeth and the head transfers the torque therethrough.

The Antonius U.S. Pat. No. 4,479,409 discloses an open-end ratchet wrench with a handle joined to a crescent shaped head. A jaw is located within the head and is removed by axial displacement. Spring biased indents and detents resist axial displacement with the ratcheting interposed between the jaw and head.

The Tesoro U.S. Pat. No. 4,270,417 discloses a removable socket of cylindrical shape with circumscribing teeth and a pair of ratcheting keys to lock the movement in an opposite direction. The rotating position is shiftable by a biasing spring mounted in a passage forming structure that presses a ball into alternative circumscribing grooves on the outer wall of the socket.

The Brooks U.S. Pat. No. 2,697,370 discloses a ratchet socket wrench which comprises three separate elements: the ratchet, drive and socket. A limited number of teeth are used in the ratchet and are spaced about the ends. When the handle is rotated in the opposite direction the teeth disengage.

The Stewart U.S. Pat. No. 1,494,513 discloses a wrench utilizing a pawl interfacing with outwardly extending teeth of a socket member. The novelty includes the use of a plurality of socket members slidably and telescopically nested within an outer socket.

The Colbert U.S. Pat. No. 145,399 discloses a wrench that uses a pair of jaws with a bush-thimble inserted in a ratchet barrel with a spring catch. A spring acts to keep the ratchet teeth together and holds the bushing and thimble together.

In summary, the applicant's wrench design differs from the prior art in that the wrench:

a) creates a simple and mechanically efficient socket wrench whose principle can be used for either a reversible, or a bidirectional system, b) can be used directly on a nut or bolt without requiring an additional socket, c) includes the option to use a special socket, which allows the bolt to penetrate through the socket and wrench, d) includes an improved adapter which allows the use of standard sockets, and the transfer of increased ratching power to the socket, e) uses a relatively small number of components, allowing for a reduced dimension of the wrench, f) accepts the use of a special ergonometrically designed handle, and g) allows the handle to be rotated 180°, for use by either a right or left handed person.

For background purposes and as indicative of the art to which the invention is related reference may be made to the remaining cited patents.

| PATENT NO. | INVENTOR | ISSUED |
|---|---|---|
| 5,365,807 | Darrah et al | 22 November 1994 |
| 5,295,422 | Chow | 22 March 1994 |
| 5,000,066 | Gentiluomo | 19 March 1991 |
| 4,903,554 | Colvin | 27 February 1990 |
| 4,819,521 | Lang | 11 April 1989 |
| 4,785,495 | Dellis | 22 November 1988 |
| 4,586,307 | Parker | 20 May 1986 |
| 4,520,697 | Moetteli | 4 June 1985 |
| 4,491,043 | Dempsey et al | 1 January 1985 |
| 4,328,710 | Shiel | 11 May 1982 |
| 4,308,769 | Rantanen | 5 January 1982 |
| 4,101,125 | Heath | 18 July 1978 |
| 3,393,587 | Jolliff et al | 23 July 1968 |
| 2,943,513 | Gray, et al | 5 July 1960 |
| 2,651,130 | Waterval | 8 September 1953 |
| 2,300,479 | Wilson | 3 November 1941 |
| 523,850 | Cavanaugh | 31 July 1894 |

DISCLOSURE OF THE INVENTION

Ratchet wrenches have been in use for decades because of their ability to forcefully and rapidly rotate by hand a threaded fastener or socket and to tighten or loosen a variety of workpieces such as bolts and nuts. One of the most common issues with existing type wrenches is the generation of a forceful rotation in one direction and free ratcheting in the opposite direction. This action requires a delicate operation of the pawls that engage the gear teeth. The failure of the ratchet to provide adequate strength for this operation can cause breakage of the pawls or gear teeth which then can produce a sudden surge of the handle. This sudden surge has the potential to cause injury to the hand.

The primary object of the invention is to eliminate a secondary locking element found on most socket wrenches and incorporate a pair of opposed gears having teeth along the entire circumference that intermesh completely with each other. The more teeth that are engaged at one time, the greater the torque exerting capabilities of the wrench and the greater the safety factor will be against breakage of the engaged teeth. As an example, 2,500 pounds per square inch (7,316 kilograms per square centimeter) is a basic torsional load, based on a currently available ratchet wrench. This same wrench has a tooth engagement equal to 67.5 pounds per square inch (30.6 kilograms per square centimeter) whereas the instant invention exerts approximately 320 pounds per square inch (145.1 kilograms per square centimeter) based on the contiguous area, which can be increased by projecting higher teeth. Since the mass of material in these higher teeth is 4.74 times greater, it can be seen that a considerable mechanical advantage may be obtained by using all of the available teeth to exert torque on the nut or bolt. In conclusion, the design of the wrench can alter the torque magnitude substantially. The angle of the teeth is also an important factor allowing easy ratcheting and positive intermeshing. A 27° angle, with a back slope of 3° has proven optimum, permitting the teeth to intermesh completely, while the back slope eliminates teeth slipping even if they may be slightly separated by the reverse rotation process.

An important object of the invention is directed to its safe use, as a slip in the prior art small gear engagement (due to wear or actual breakage of engaging teeth) may cause injuries to the users hand. Additionally, the usage of socket wrenches in tight quarters having sharp objects can contribute to the danger as well.

Another object of the invention is the ease in which the wrench rotation may be changed. In the first embodiment the wrench is simply turned over and the rotation is automatically reversed with no change levers involved. In the preferred embodiment the wrench contains a double set of gears and teeth and the change of rotational engagement is accomplished by sliding a switch bar within the handle. In all cases, the action is positive and easily performed.

Still another object of the invention includes an ergonometrically shaped handle that is larger than those used on prior art wrenches, which allows more force to be exerted by the wrench. This handle includes finger grooves on one side and a curve on the other which duplicates the inside shape of a grasped hand. Therefore, there is less hand fatigue and the wrench is easier to grasp which permits the wrench to generate a greater torque. The handle shank is fixed and rigid relative to the ratcheting head. However, before directionally rotated, the handle may be pulled from the shank away from the head and rotated 180°. When the handle is released it automatically snaps back into place in the new position, conforming to left or right hand use, or to different rotating directions. The handle of the second embodiment is likewise concerned with the hand of the worker, providing finger grooves and a thumb rest for comfort and a removable knuckle guard for protection.

Yet another object of the invention is its flexibility. The ratcheting sleeve opening can be selected to be the same size as the nut or bolt eliminating the need of a socket. Also, the center of the wrench is open, thus eliminating the problem of a stud or threaded portion of the bolt hitting the inside upper end of the socket. In both wrench embodiments, if the nut is a different size than the sleeve opening, a special socket may be used. This special socket has an upper outer section that interfaces with the center sleeve of the ratchet and the inside of the socket fits over the nut. In a different configuration, an adapter may be utilized, having a hex projection on the outside and a square protrusion on one or both extremities. These are presently used in standard ¼, ⅜ or ½ inch socket drives, which in turn, use conventional sockets. This adapter is introduced on the hex shaped center opening of the wrench. A weak point of the existing adapters is the straight, sharp corner located between the body of the adapter and the square protrusion which is inserted into the opening of the standard socket. This weak point is reduced by replacing the straight, sharp corner with a rounded corner which also increases the amount of the transferred power.

A further object of the invention that is applicable to the preferred embodiment, is an attachment that permits the wrench to rotate manually which then allows a bolt or nut to be rotated by two fingers. The manual rotation is accomplished by twisting a knurled or serrated drive disc which is located in the upper end of the centersleeve.

A final and important object of the invention is the simplicity, reliability and ease of manufacture.

These and other objects and advantages of the present invention will become apparent from the subsequent detailed description of the preferred and other embodiments, also from the appended claims, further taken in conjunction with the accompanying drawings.

BEST MODE FOR CARRYING OUT THE INVENTION

The best mode for carrying out the invention is presented in terms of a reversible unidirectional wrench and a bidirectional wrench. Both wrench designs are similar in design except that the unidirectional wrench utilizes only one pair of gears having circumferential teeth, while the bidirectional wrench employs two pairs of gears with gear teeth.

Figure 3:
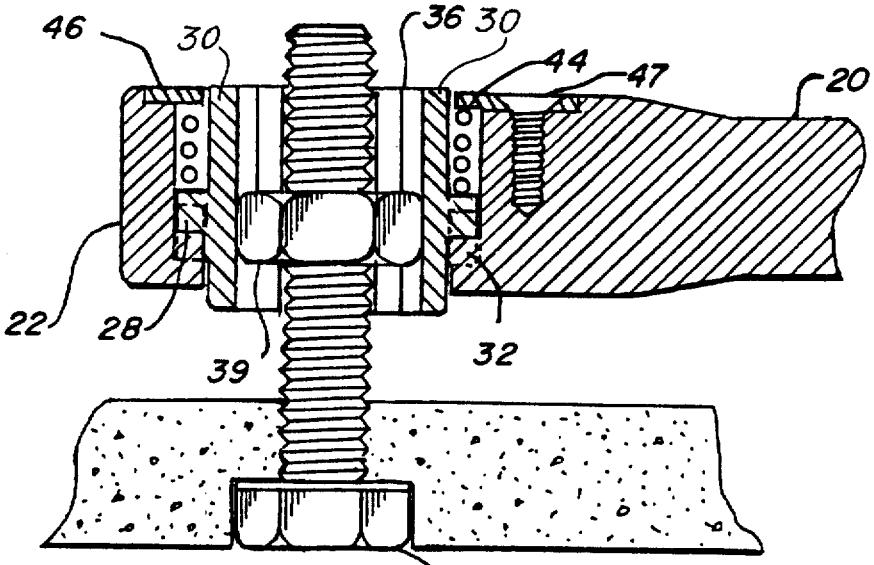
FIG. 3 is a cross sectional view taken along lines 3—3 of FIG. 1 with a nut and bolt penetrating the sleeve of the ratchet and with the head of the bolt imbedded in a rigid material.
Figure 4:
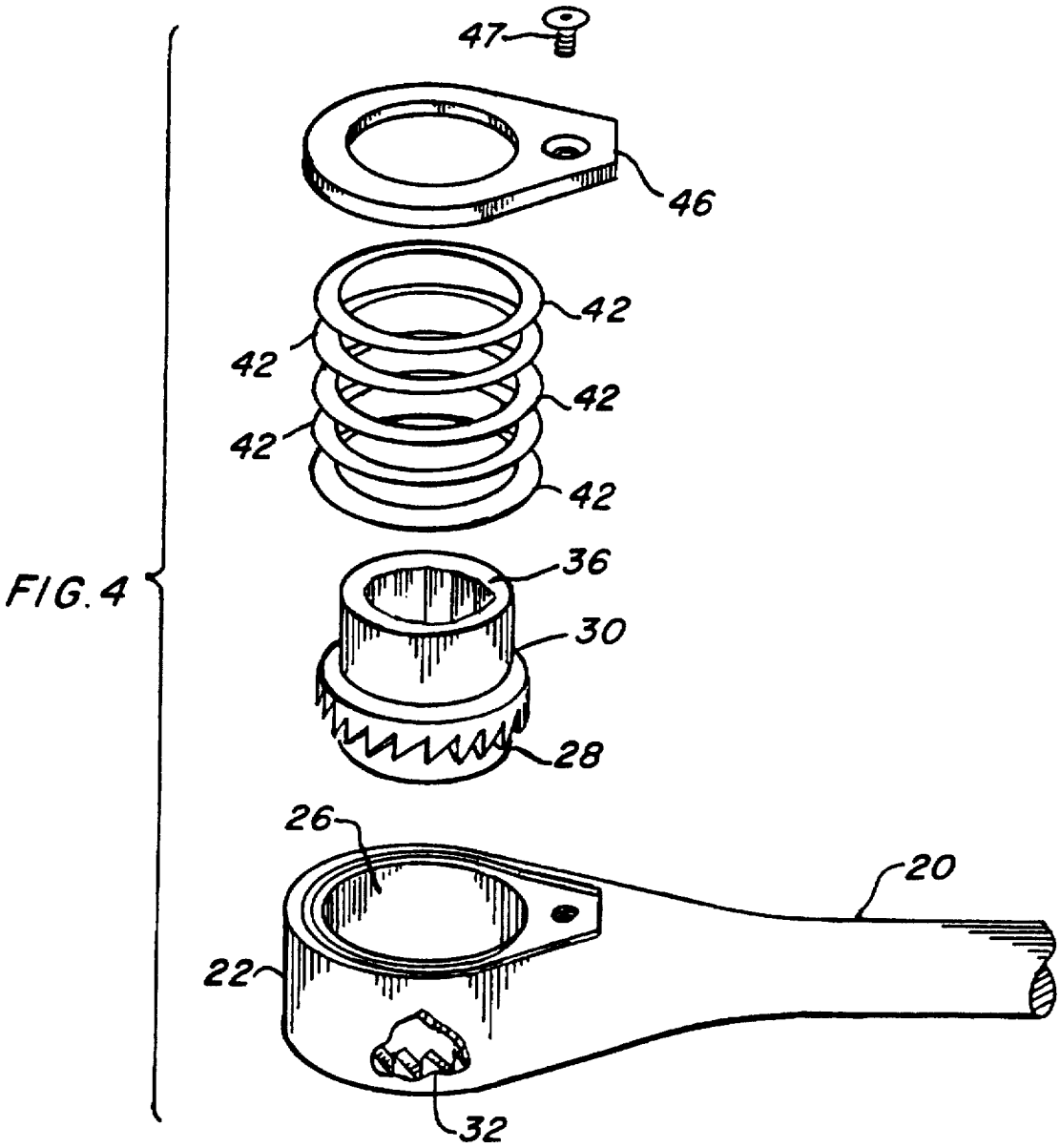
FIG. 4 is a partial exploded perspective view of the reversible wrench, less the handle.
Figure 5:
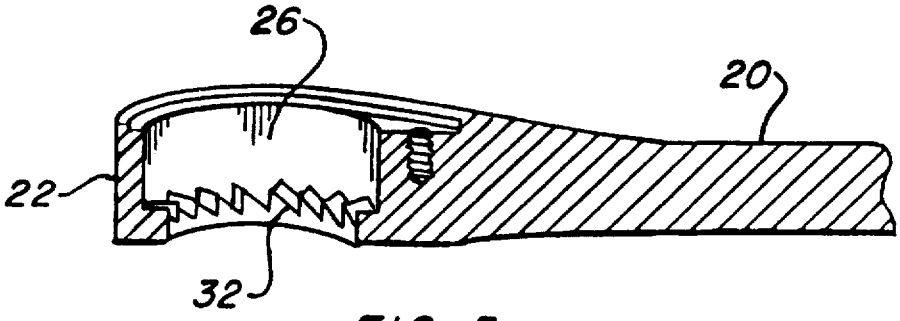
FIG. 5 is a partial cross sectional view of the gear assembly housing taken on the longitudinal centerline.

The basic unidirectional embodiment, as shown in FIGS. 1 through 16, is comprised of a shank 20 which includes a housing 22. The housing 22 has a recessed round bore 26 which is recessed larger on the upper side. A set of upwardly directed female gear teeth 32 protrude within the recess of the round bore 26. The gear teeth are spaced apart to permit sufficient meshing during oscillation. FIG. 4 illustrates the gear tooth assembly in an exploded perspective view and FIG. 5 shows the housing 22 in a longitudinal cross section, where the female gear teeth 32 are part of the housing 22.

Figure 6:
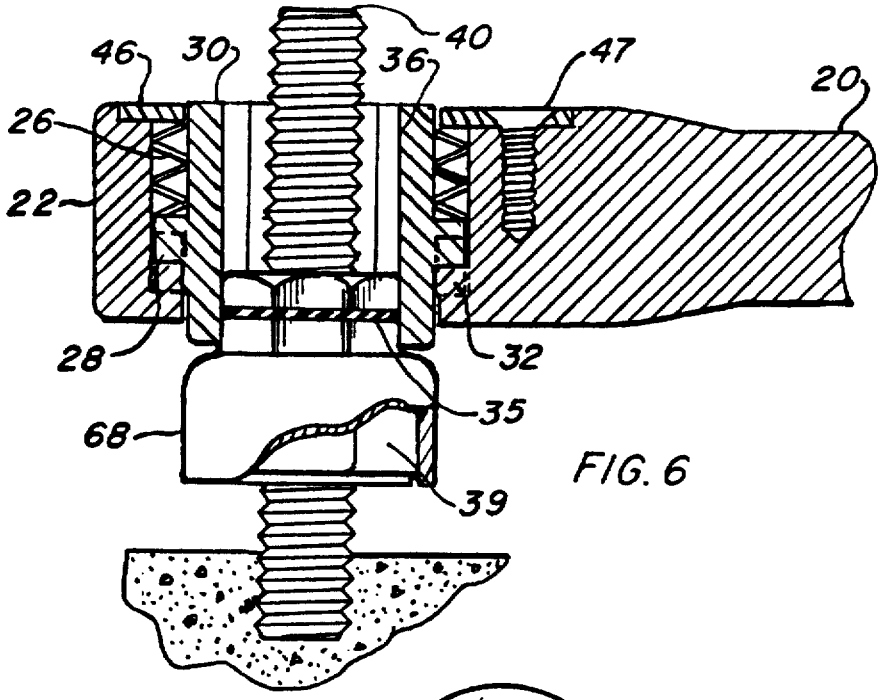
FIG. 6 is a partial longitudinal cross sectional view of the reversible wrench taken on the centerline, with a special socket engaged by the ratchet and the socket engaging a nut.

A hollow sleeve 30 is placed inside the shank's recessed round bore 26. The sleeve 30 includes the male gear teeth 28 which mate with the female gear teeth 32. When these teeth are intermeshed and an oscillating motion is applied to the handle 20, they activate the gears with teeth in a ratcheting motion in one rotational direction and disengage and slide apart when rotated in the opposite direction. It should be noted that the teeth 28 and 32 are equally spaced and intermesh with each other. The angle of each individual tooth 28 and 32 may be between 25° to 30° as measured from a horizontal plane. This angle is designated "a" in FIG. 22 with 27° being the preferred angle. Each tooth has a back slope of 2° to 4° with 3° being the preferred, as designated "b" in FIG. 22. Further, the sleeve 30 also includes a twelve-sided polygonal opening 36 on the inside of the hollow portion. The polygonal opening 36 is designed to accept a workpiece in the form of a hex nut 39 or a hex bolt 40. However, using the unidirectional wrench for different sizes of nuts requires different special sockets for each size of nut. The socket 68 has an external upper shape that mates with the hexagonal opening 36 in the sleeve 30 and an internal hex shape at the lower end that mates with a workpiece 39 or 40. Also, the extending threaded portion of the bolt 40 may easily penetrate the twelve-sided opening 36 of the ratchet and the socket as shown in FIGS. 3 and 6. Thus, eliminating the problem encountered with conventional standard sockets, where in similar situations it is necessary to use deep sockets.

Figure 2:
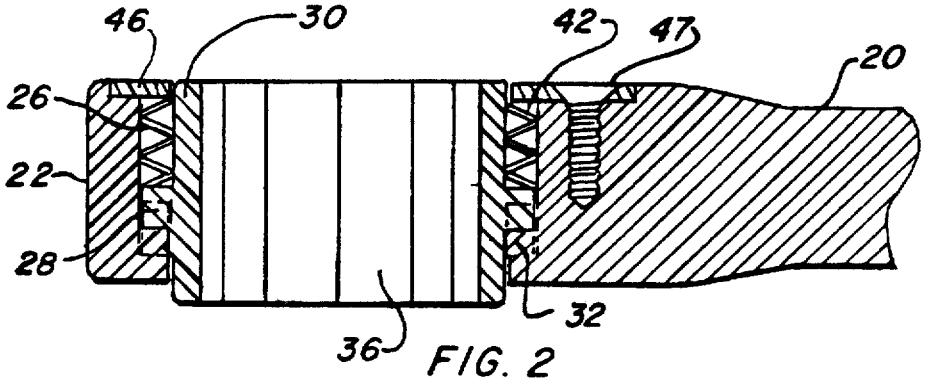
FIG. 2 is a cross sectional view taken along lines 2—2 of FIG. 1.

A spring means, preferably in the form of a number of Belleville disc springs 42, are stacked together in an opposed manner, as best illustrated in FIG. 2. These springs are positioned between the recess in the bore 26 and the exterior of the enclosure sleeve 30 for the purpose of urging the male 28 and female 32 gear teeth to intermesh. Another design of the spring means consists of a coiled-wire compression spring 44 that is located within the recess as shown in active FIG. 3. When the wrench handle is oscillated in the active direction, the gear teeth 28 and 32 interlock tightly in one direction, creating the desired rotational working torque. In the opposite passive direction of the oscillation, the angular surface of the gear teeth force the teeth apart, against the downward pressure exerted by the springs 42 or 44, so that they may automatically ratchet. This passive oscillation of the wrench handle moves the sleeve 30 slightly upwards, for at least the distance equivalent to the depth of the teeth. A cover plate 46 is attached to the housing gear assembly 22 with one or more cover fasteners 47 to cover and press down on the compression springs 42 or 44 and to eliminate any accumulation of dirt and grease in the covered area.

Figure 1:
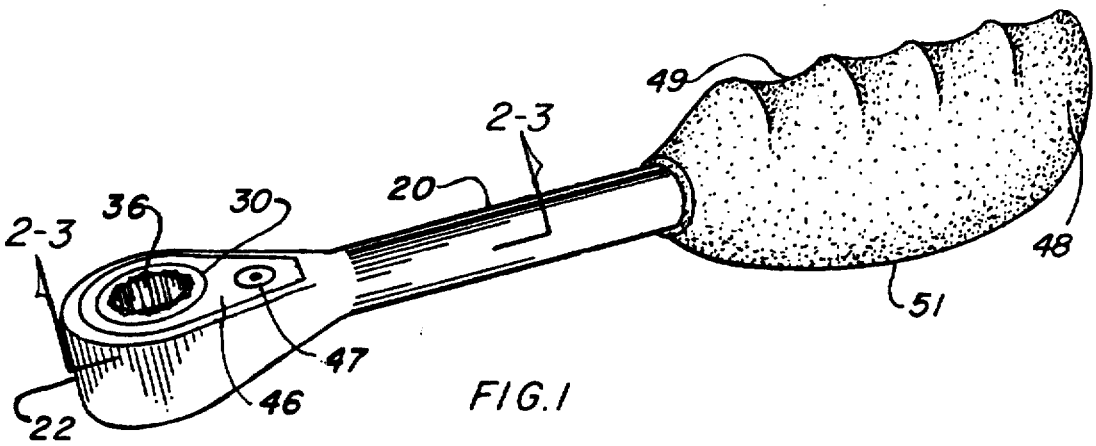
FIG. 1 is a perspective view of the reversible ratcheting wrench.
Figure 10:
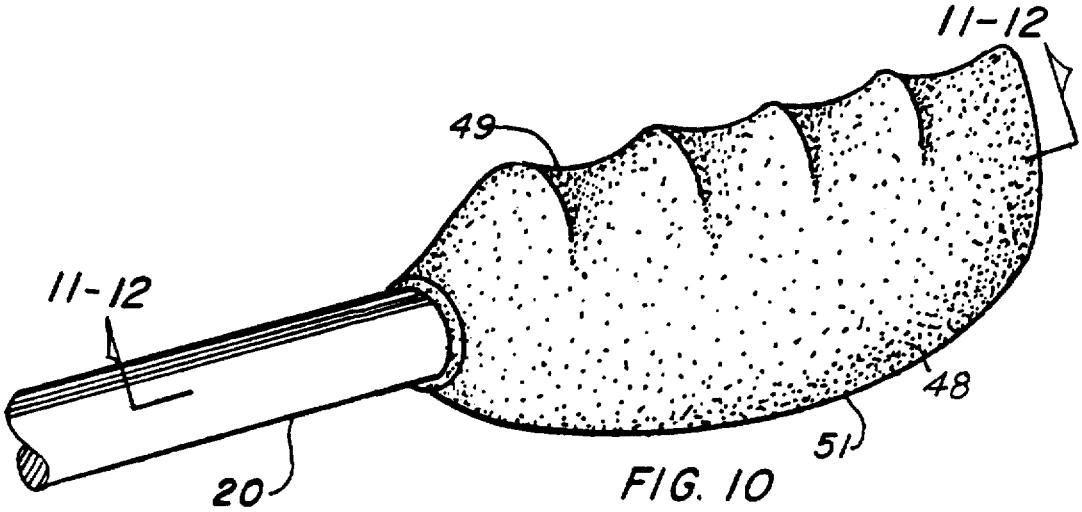
FIG. 10 is a partial perspective view of the first ratchet handle embodiment.
Figure 11:
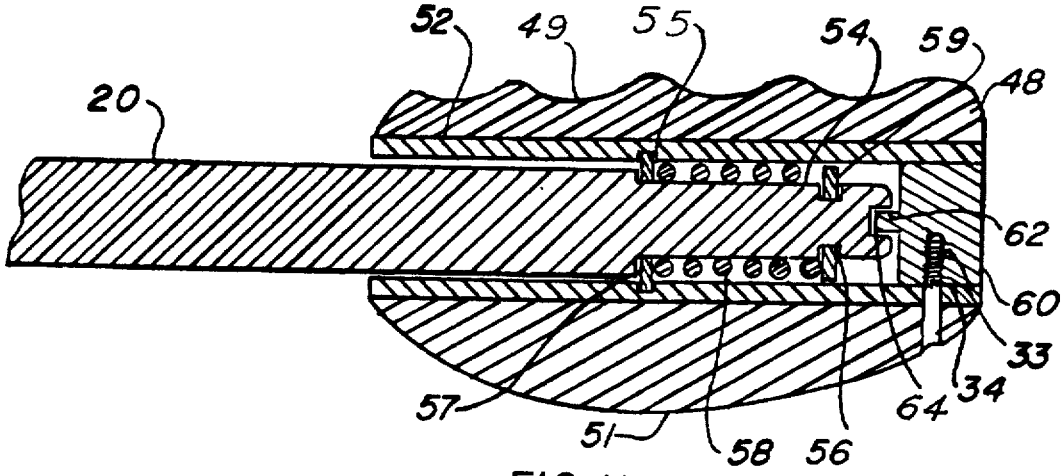
FIG. 11 is a cross sectional view of the first ratchet handle, taken along lines 11—11 of FIG. 10.
Figure 12:
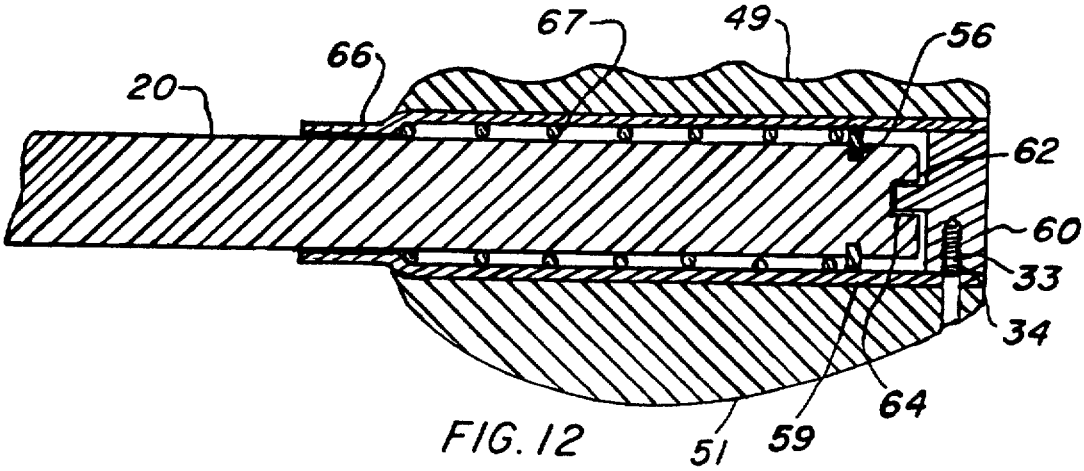
FIG. 12 is a cross sectional view longitudinal taken along lines 12—12 of FIG. 10 illustrating the second ratchet handle embodiment.

As shown in FIGS. 1, 10 and 11, the end of the shank 20 incorporates an ergonomically shaped handle 48. The longitudinal cross section of the handle 48 is illustrated in FIGS. 11 and 12 and contains a grip having external finger grooves 49 on one side and a palm shaped curve 51 on the opposite side. The shape of the grip is designed to easily fit the palm and fingers of a hand, thus requiring less effort to maintain the same amount of force, while holding and activating the ratchet. A straight hollow sleeve 52 is molded or pressed into a bore in the handle 48 and together they are positioned rotatably on the end of the handle 20. The sleeve 52 includes a groove 55, to accommodate a snap ring 57. The handle end further includes a reduced diameter shoulder 54. A handle compression spring 58 is positioned in the hollow space between the sleeve 52 and the reduced diameter shoulder 54. The spring is held in place by a retaining means in the form of snap rings 57 and 59 as shown in FIG. 11. The snap ring 57 is placed in the groove 55, and the compressed spring 58 is slid over the reduced diameter at the end of the handle 20. The snap ring 59 is then placed in the groove 56 to maintain the compression of the spring 58. In this way, the spring 58 exerts a constant pressure to increase the distance between the snap rings 57 and 59.

A plug cap 60 as shown in FIGS. 11 and 12, is attached to the inside end of the sleeve 52 blocking the open end. The plug cap 60 further includes a flat blade 62 projecting inwardly and interlocking into a slot 64 located at the end of the handle shaft 20. When the handle 48 is manually pulled outwardly away from the end of handle shaft 20 and rotated 180° before being released, the handle 48 is repositioned for operation in the opposite oscillating mode, or to allow the wrench to be operated with the other hand. The plug cap 60 is held within the sleeve 52, by a screw 33 inserted through a threaded bore 34, in the handle 48 and sleeve 52.

The second handle embodiment is depicted in FIG. 12 and functions in similar manner as described above. The difference between the two handles is that the straight hollow grip sleeve 52 is replaced by a stepped grip sleeve 66, and the reduced diameter shoulder 54 of FIG. 11 is omitted. The compression spring 67 is basically the same as spring 58 shown in FIG. 11, except that it slips over the entire end of the shank 20 and is held on the forward end by the reduced diameter step of the sleeve 66. The parts 56, 59, 64, 32, 33 and 62 are substantially the same as shown in FIG. 11, creating a similar functioning mode as shown in the first handle embodiment.

Figure 7:
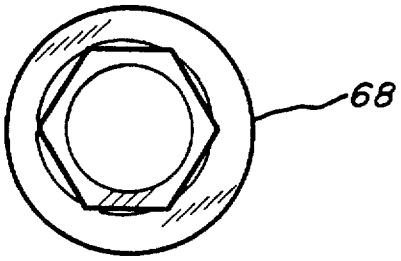
FIG. 7 is a top view of a special socket, as shown in a side view in FIG. 6.
Figure 8:
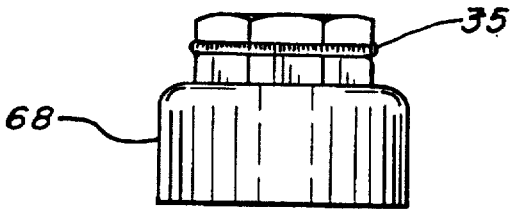
FIG. 8 is a side view of a special socket, as shown in FIG. 6.
Figure 9:
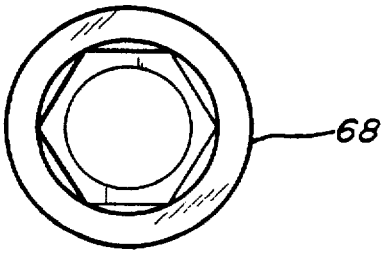
FIG. 9 is a bottom view of the special socket with the internal lower surface being in a hex shape.

As previously mentioned and shown in FIG. 3, the wrench head 22 of the unidirectional wrench in the first embodiment, is placed over the nut 39 and/or bolt 40. When the wrench handle is oscillated in the active direction, the gear teeth 28 and 32 lock the teeth together and rotate the workpiece. Removing the wrench from the workpiece, and turning it over, permits the active ratcheting of the wrench in the opposite direction. In this embodiment, the twelve-sided polygonal opening 36 is the same size as the workpiece 39. However, when the workpiece is larger or smaller than the opening 36, or the enclosure sleeve 30, a special socket 68 may be utilized, as illustrated in FIG. 6. FIGS. 6 and 8 show a ring 35, manufactured from a resilient material which is placed around the upper end of the special wrench socket 68. The details of the special socket 68 are shown in FIGS. 7, 8 and 9.

Figure 13:
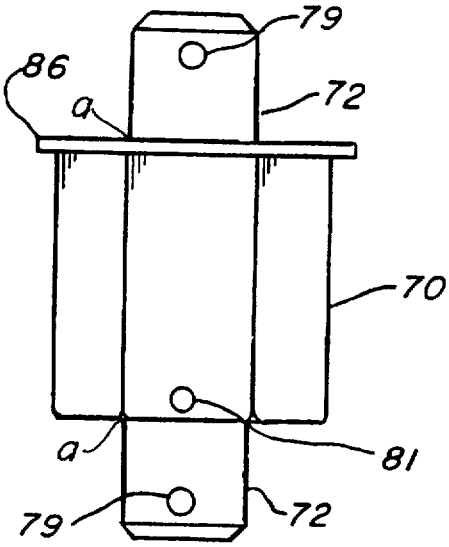
FIG. 13 is a elevational view of a prior art double ended socket adapter.
Figure 14:
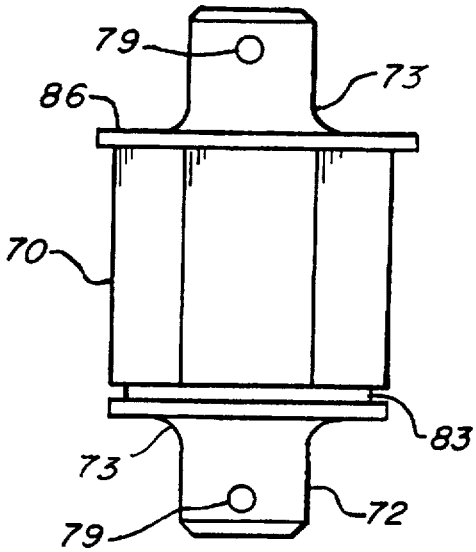
FIG. 14 is an elevational view of a modified double ended socket adapter.
Figure 17:
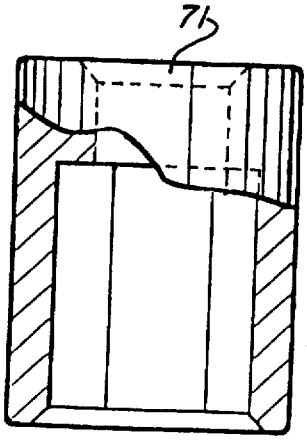
FIG. 17 is an elevational cutaway view of a having a radiused upper section.

Still another configuration employs an existing adapter 70 as depicted in FIG. 13 and an improved adapter in FIG. 14, which can be mounted in the opening of the wrench head sleeve 36, to allow the use of conventional sockets, such as shown in FIG. 17. The body of the adapter 70 has a hexagonal shape to mate with the inside of the polygonal opening 36 of the sleeve. The adapter also contains a square projection 72 on each end corresponding in dimensions to the upper openings of the standard sockets 71 (such as ¼, ⅜ or ½ inch drives), as typically shown in FIG. 17.

Figure 15:
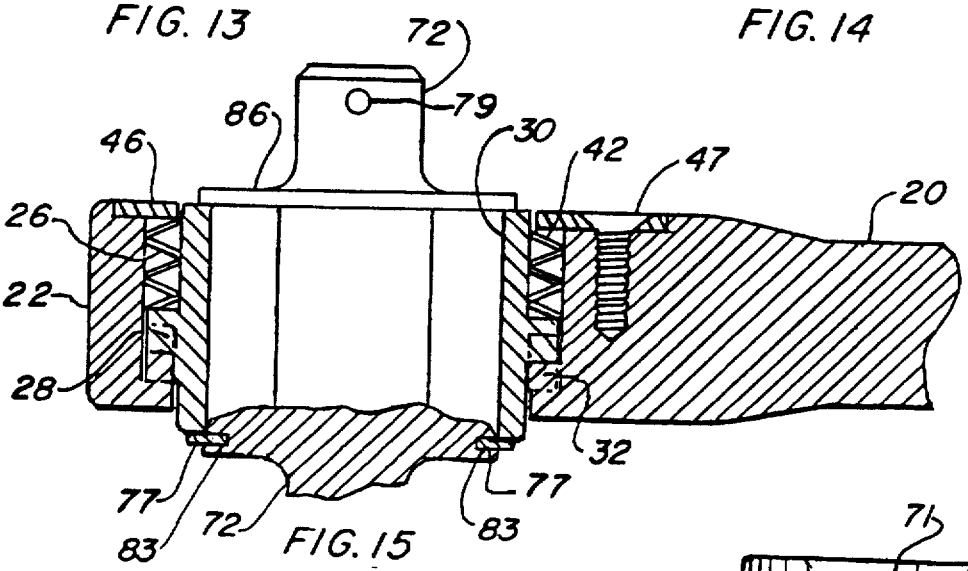
FIG. 15 is a cross sectional view of the first wrench embodiment with the modified double-ended socket adapter in place.
Figure 16:
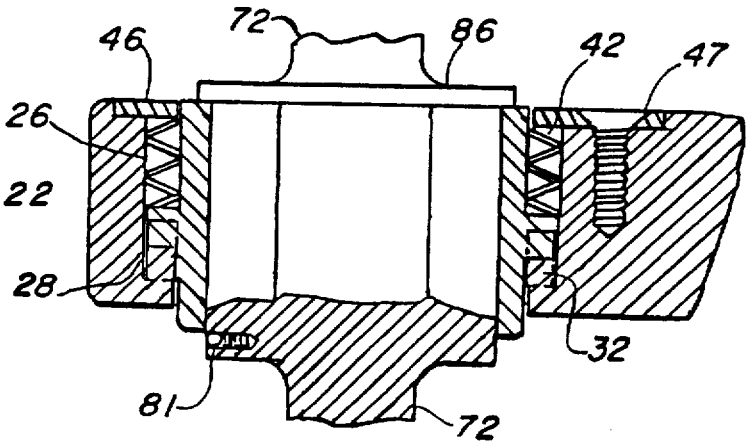
FIG. 16 is a cross sectional view of the first wrench embodiment with a modified double-ended socket adapter in place.

The standard square end projection 72 on the adapter 70 includes a weak point where the projection meets the body of the adapter at a 90° angle, shown as point "a" in FIG. 13. To alleviate this problem, radiused section 73 is provided as shown in FIG. 14, to unite the straight outside surface of the adapter 70 with the perpendicular side of the adapter body as shown in FIG. 14. To accommodate the radiused section of the adapter, the upper body of the standard socket must also have a corresponding radiused section 71 as shown in FIG. 17. The original adapter 70 can be held in place in the polygonal opening 36, by the adapter's upper lid 86 and a retaining spring washer 77, located in a snap ring groove 83 as shown in FIG. 15. This method of securing the adapter 70 in the polygonal opening 36 can also be achieved with the upper lip 86 and a spring loaded ball 81 as shown in FIGS. 13 and 16.

To emphasize the similarities in function, between the first and preferred embodiment, the preferred wrench embodiment is depicted in FIGS. 18–29 and provides the same function as the first embodiment, but is designed to be bidirectional in order to change the rotational direction. The preferred wrench embodiment may remain on the workpiece while the rotational direction of the wrench may be manually changed by a switching means 160 located within the handle 148. Further, the handle 148 is somewhat different in configuration however, it includes the ergonomic shape of the preferred embodiment, plus a removable knuckle protector 150.

For distinction and clarity of the description of this preferred embodiment, the nomenclature of each element has been retained but the identification numbers are in the 100 series for simplicity of differentiation.

Figure 18:
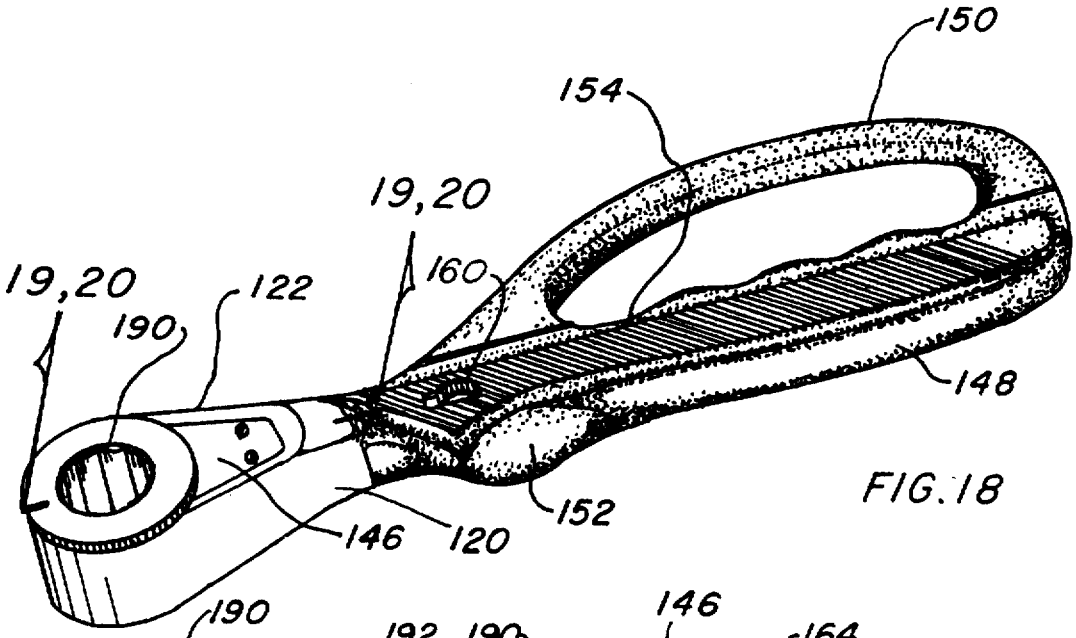
FIG. 18 is a perspective view of the preferred ratchet and third handle embodiment.

FIG. 18 is a perspective view of the preferred embodiment of the bidirectional wrench including the ergonomic handle 148, incorporating the knuckle protector 150. The wrench also includes a ratchet housing 122 with a cover plate 146, and a shank 120.

Figure 19:
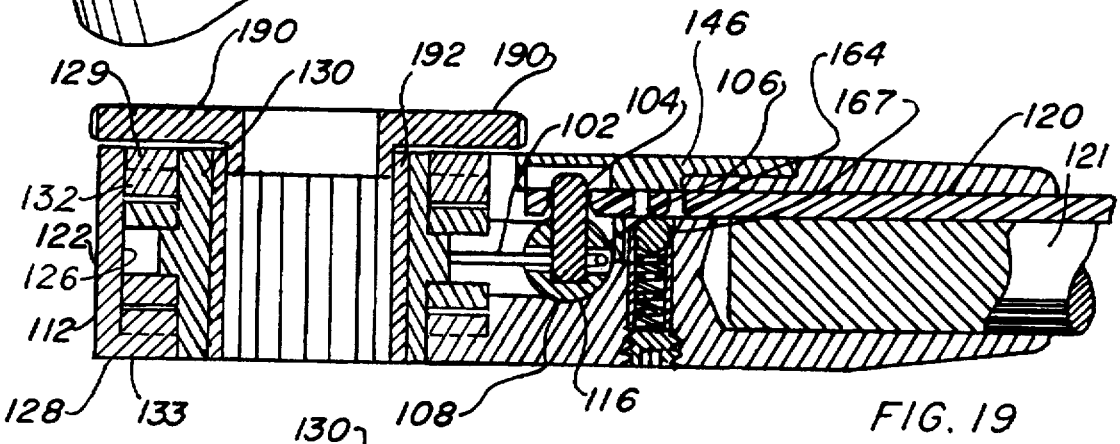
FIG. 19 is a cross sectional view taken along lines 19—19 of FIG. 18 with the ratchet direction in the neutral position.
Figures 21, 22:
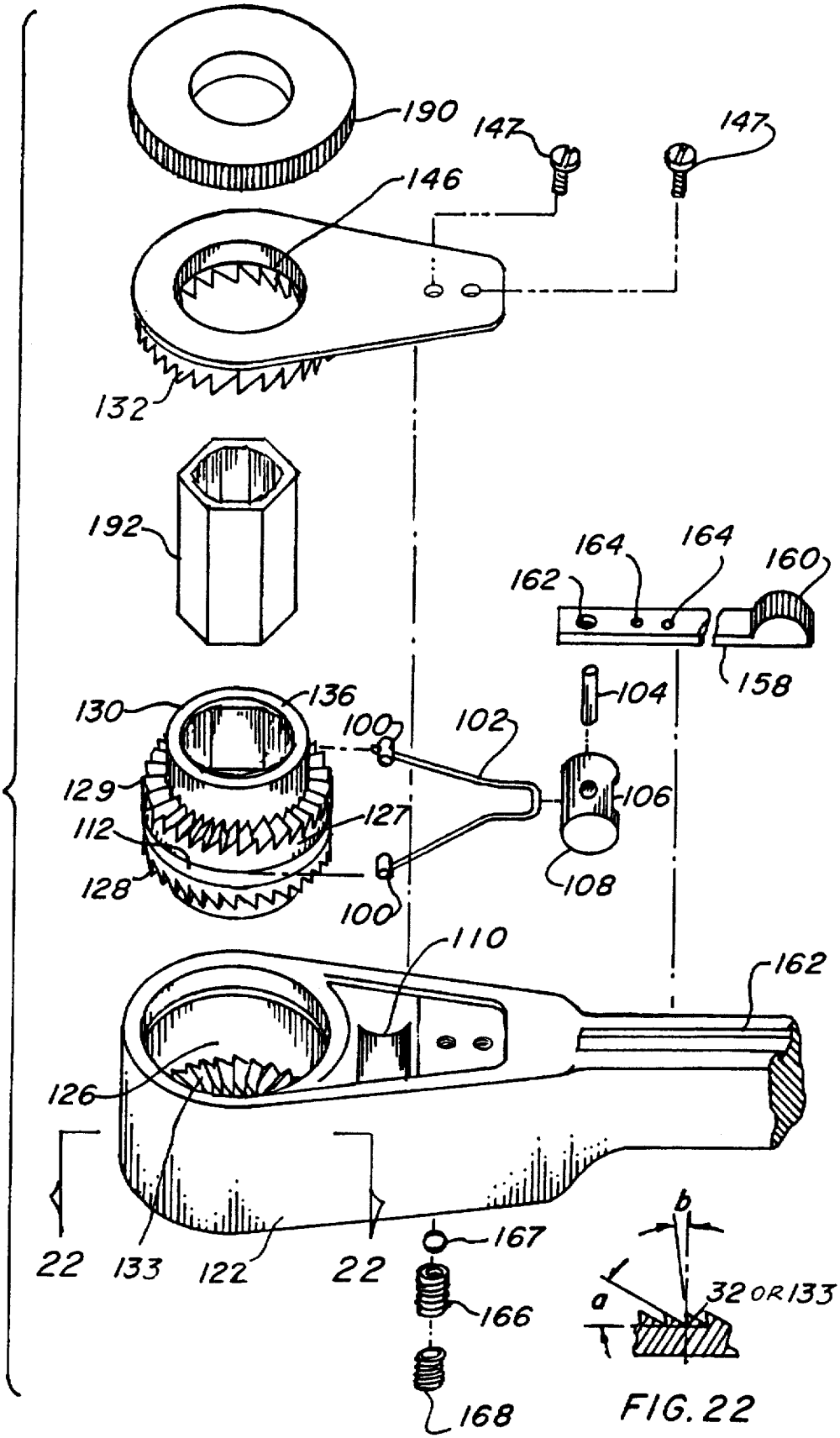
FIG. 21 is a perspective exploded view of the preferred wrench embodiment, less the handle.
FIG. 22 is a partial side elevational view taken along lines 22—22 of FIG. 21.
Figure 23:
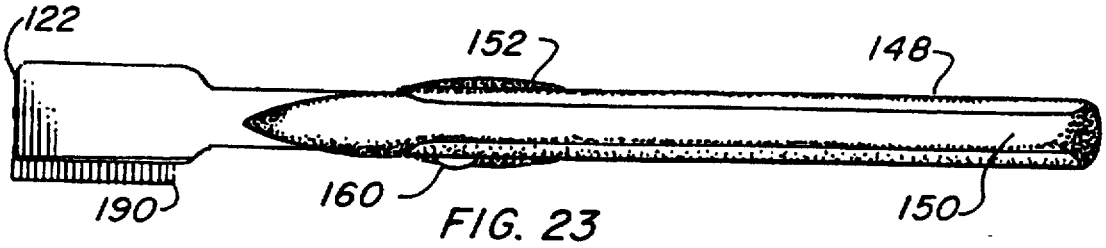
FIG. 23 is a right side view of the preferred wrench embodiment.
Figure 24:
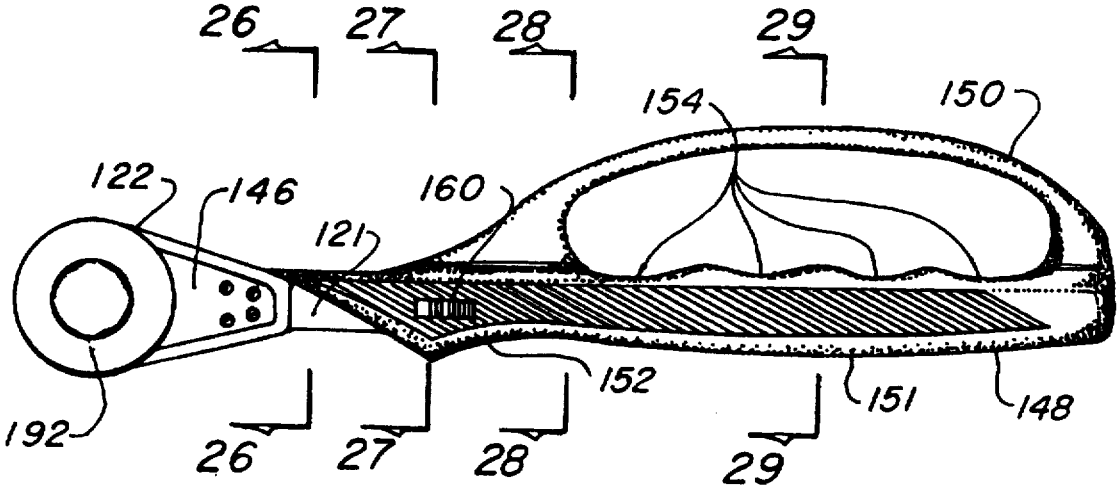
FIG. 24 is a top view of the preferred wrench embodiment.
Figure 25:
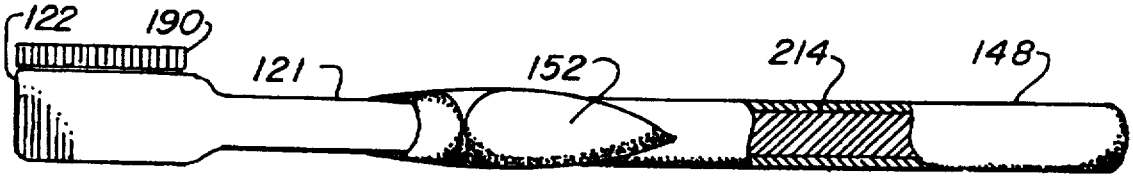
FIG. 25 is a left side view of the preferred wrench embodiment.
Figure 26:
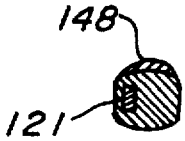
FIG. 26 is a cross sectional view taken along lines 26—26 of FIG. 24.
Figure 27:
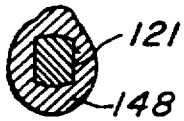
FIG. 27 is a cross sectional view taken along lines 27—27 of FIG. 24.
Figure 28:
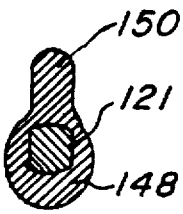
FIG. 28 is a cross sectional view taken along lines 28—28 of FIG. 24.
Figure 29:
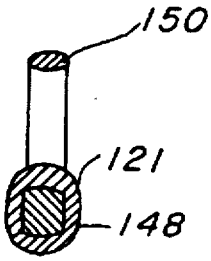
FIG. 29 is a cross sectional view taken along lines 29—29 of FIG. 24.

FIG. 19 shows a partial, longitudinal sectional view of the operating portion of the preferred embodiment. The front end of the housing 122 contains a recessed round cavity 126. The cavity 126 contains lower housing female gear teeth 133 as shown in FIG. 21. Further, within the cavity 126 is rotatably located a hollow center sleeve 130. This center sleeve includes a double face gear having upper male gear teeth 129 and lower male gear teeth 128. The space between the teeth 128 and 129 define a groove 112. The center sleeve 130 is formed as a six-sided polygonal opening 136 on the inside hollow portion. This center sleeve 130 accepts a rotating centerpiece hex sleeve 192 with a hex shaped outside and a twelve-sided inside which can accept a hex nut 39, a hex bolt 40 or a special socket 68.

It should again be noted that the gear teeth 128, 129, 132 and 133 are formed to intermesh with each other and include an equally spaced number of teeth as illustrated on the gear teeth segment in FIG. 22. The angle of each individual tooth is identical in all the embodiments.

Figure 20:
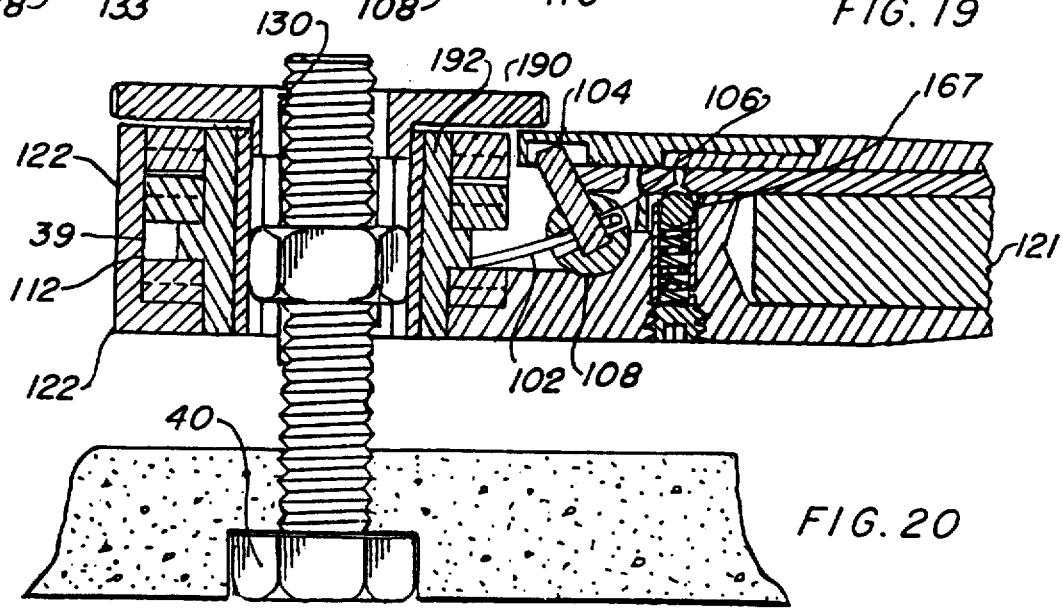
FIG. 20 is a cross sectional view taken along lines 20—20 of FIG. 18 with the ratchet activating the lower gear teeth and a nut in place.

Spring means 100, 102, 104 and 106 as shown in FIGS. 20 and 21, are positioned within the housing 122. These spring means urge the teeth of one of the selected female sleeve gear teeth 132 or 133 into one of the male teeth 128 or 129, permitting the gear teeth to mesh in the chosen rotational direction and slide apart and rotate freely in the opposite direction. This function is accomplished using the rocking log 108 that is pivotally disposed within a cavity 116 in the ratchet shank 120 behind the housing 122. The rocking log 108 further contains a cavity with a bore 106 and a rocking log pin 104 extending from the log in an upward direction. The back end of a wire spring 102 is positioned through the log cavity 106 as shown in FIG. 21. The spring 102 further includes at the front ends two cylindrical pieces 100, slightly smaller in diameter than the groove 112, which slide between the rotating male gears 128 and 129. The two front ends 100 of the spring 102 slip in the groove 112. The back ends of the spring 102 slip into the slot 106 and are finally secured in this position with the help of the pin 104. When the rocking log 108 and the log pin 104 are rotated 15°, the front ends 100 of the spring 102 are tilted and urge one of the center male sleeve gear teeth 128 or 129 into contact with the opposed female housing gear teeth 132 or 133. The constant flexible tension of the spring 102 holds the teeth together, while allowing them to disengage and ratchet freely in the opposite rotational direction while still under the flexible tension of the spring 102.

An additional feature of this preferred embodiment is the potential use of a manual spinner 190 that is attached by pressing into the top end of the centerpiece hex sleeve 192 with a pressed fit as shown in FIGS. 19 and 20. The spinner disc 190 has a slightly larger outside diameter than the ratchet housing 122 and is knurled or serrated on the periphery for easier manual gripping and rotating. The centerpiece hex sleeve 192 and the rotating center sleeve 130 are attached together by their identical hex surfaces. Therefore, when the centerpiece hex sleeve 192 rotates, the rotating center sleeve 130 also rotates. The center sleeve 130 is also engaged in a vertical slide within the ratchet housing 122, and this changes the engagement of one of the sleeve gear teeth 128 or 129, but the rotating centerpiece hex sleeve 192 remains vertically stationary. This function permits a manual rotation, or spinning, of the centerpiece hex sleeve 192 and its accompanying rotating center sleeve 130 in either direction.

Located within the back end of the ratchet housing 122 are the switching means for changing the rotational direction of the wrench. This switching means requires moving the ends of the spring 102 vertically up and down and is accomplished by the use of a switch bar 158 as shown in FIG. 21. This switch bar 158 includes a thumb grip 160 on one end and a countersunk cavity 162 on the other end with a pair of pin receiving bores 164 adjacent to the cavity 162. The back end of the ratchet housing 122 includes a longitudinally extended slot 162 into which the switch bar 158 is slidably received. A switching detent consisting of a detent spring 166 and pressure ball 167 is retained with a detent set screw 168. The rocking log pin 104 penetrates the counter sunk cavity 162 in the switch bar 158 and the spring loaded detent ball 167 is pushed into one of the pin receiving bores 164. When the thumb grip 160 is slid within the slot 162, the ball 167 is pushed from one bore 164 to another while simultaneously oscillating the log 108, thus changing the angle of direction of the spring wire 102 and subsequently the rotational direction of the wrench itself. If the workpiece 39 or 40 is the same size as the twelve-sided polygonal opening of the centerpiece 192, as shown in FIG. 20, the wrench may be used by itself. However, if the workpiece 39 or 40 is larger or smaller than the opening of the center sleeve 192, a special socket 68 such as previously described and illustrated in FIGS. 6–9 may be utilized. The other configuration illustrated in FIGS. 13–16 use standard sockets with an adapter. These may be used with this wrench embodiment which include variations of the adapter 70.

A cover plate 146 encloses the back opening in the ratchet housing and is held in place by at least two screws 147. The cover includes the female gear teeth 132 and maintains the position of the rocking log 108. During operation of the preferred embodiment, the center sleeve 192 is placed over nut 39 or bolt 40. The drive disc 190 is then rotated by hand until the workpiece is fairly tight. The handle is then oscillated until the workpiece is tightened. To change the rotational direction of the ratchet, the thumb grip 160 is slid to the opposite position. There is a neutral position when the ball 167 is between the bores 164 as shown in FIG. 19 or it is positively locked in one working position, as illustrated in FIG. 20.

As shown in FIGS. 18 and 19, an ergonomically designed handle 148 provided with a knuckle protector 150 is positioned on the handle bar 121 of the ratchet housing 122. The handle activates the ratchet wrench and the protector 150 prevents injury to the operator's knuckles. The handle extension which may be round, rectangular or a combination of both, is made of the same material as the ratchet housing 122. This material is preferably forged steel and may be an integral or a separate piece from the ratchet housing. Handle grip 148 is formed of a thermoplastic or a like material and is installed upon the handle extension. In addition to the knuckle protector 150, the handle 148 also may include a thumb rest 152, finger grooves 154 and an optional opening for the thumb grip switch 160 of the switch bar 158. The knuckle protector 150 may also be designed to be removable from the body of the ergonomically shaped handle 148.

While the invention has been described in complete detail and pictorially shown in the accompanying drawings, it is not to be limited to such details, since many changes and modifications may be made in the invention without departing from the spirit and scope thereof. For example, the basic concept of incorporating a mechanism having a pair of opposed gear teeth along the entire circumference, as shown in FIGS. 4 and 5, that intermesh completely with each other, can also be applied to other types of hand tools. One of these "other" tools is a bolt cutter. By using the bolt cutter's two handles to produce a ratcheting action, a gradual transmission of force can be applied to shear a bolt. The use of the inventive concept also allows the length of the bolt cutter's handles to be substantially shortened. Hence, it is described to cover any and all modifications and forms which may come within the language and scope of the appended claims.

I claim:

1. A ratcheting socket wrench with intermeshing gears, comprising:

a) a shank having a front end and a back handle end with the front end further having a housing with a recessed round bore therethrough and a set of upwardly directed female gear teeth within the recessed round bore, b) a hollow sleeve disposed rotatably within said recessed round bore having a set of integral male gear teeth positioned to mate with said upwardly directed female gear teeth such that the teeth mesh in one rotational direction and slide apart and rotate freely when rotated in an opposite direction, c) spring means positioned between the shank recessed round bore and the hollow sleeve to urge the mating gear teeth together, d) a cover plate joined to the shank front end to cover and retain the spring means, and e) an ergonomically shaped handle positionably disposed on a back end of said handle for gripping thereupon, the wrench therefore locking the gear teeth securely when rotating a workpiece within the hollow sleeve in one direction and ratcheting freely when rotating in an opposite direction also when removed from a workpiece and turned over, the wrench rotates a workpiece oppositely, said handle further comprises:

(1) a grip having external finger grooves on one side and a palm shaped curve on the other and a straight hollow grip sleeve within, disposed over the shank.

(2) said shank further having a reduced diameter shoulder and a slot on the handle end, (3) a handle compression spring positioned between the shank shoulder and the grip sleeve to urge the grip toward the handle end of the shank, (4) spring retaining means within the grip sleeve to hold the spring in compression and, (5) a plug cap attached to the grip, blocking the hollow sleeve, the cap further having a flat blade projecting inwardly toward the shank with the blade interlocking into the slot in the shank such that when the handle is urged outwardly toward the shank handle end and rotated 180 degrees, the grip is repositioned, when released, for operation of the wrench in the opposite rotational mode.

2. A ratcheting socket wrench with intermeshing gears, comprising:

a) a shank having a front end and a back handle end with the front end further having a housing with a recessed round bore therethrough and a set of upwardly directed female gear teeth within the recessed round bore, b) a hollow sleeve disposed rotatably within said recessed round bore having a set of integral male gear teeth positioned to mate with said upwardly directed female gear teeth such that the teeth mesh in one rotational direction and slide apart and rotate freely when rotated in an opposite direction, c) spring means positioned between the shank recessed round bore and the hollow sleeve to urge the mating gear teeth together, d) a cover plate joined to the shank front end to cover and retain the spring means, and e) an ergonomically shaped handle positionably disposed on a back end of said handle for gripping thereupon, the wrench therefore locking the gear teeth securely when rotating a workpiece within the hollow sleeve in one direction and ratcheting freely when rotating in an opposite direction also when removed from a workpiece and turned over, the wrench rotates a workpiece oppositely, said handle further comprises:

(1) a grip having external finger grooves on one side and a palm shaped curve on the other side and a stepped sleeve within, disposed over the shank, (2) said shank further having a slot in the back handle end, (3) a handle compression spring positioned between the shank and the stepped sleeve urging the grip toward the handle end of the shank, (4) spring retaining means to hold the spring in compression, and (5) a plug cap attached to the grip, blocking the stepped sleeve, the cap further having a flat blade projecting inwardly toward the shank with the blade interlocking into the slot in the shank such that when the handle is urged outwardly toward the shank handle end and rotated 180 degrees, the grip is repositioned, when released, for operation of the wrench in the opposite directional mode.

3. A socket wrench transmitting bidirectional torque through intermeshing gear teeth, comprising:

a) a ratchet housing having a top, a bottom, a front end and a back end with the front end further having a recessed round cavity with lower housing female gear teeth integral with the bottom of the recessed round cavity, b) a cover plate attached to the top of the housing, said cover plate having downwardly depending female gear teeth, c) a hollow center sleeve disposed rotatably within said housing round cavity having upper male gear teeth and lower male gear teeth with said sleeve having a groove formed between the upper and lower gears, d) a rotating centerpiece hex sleeve having a hex shaped outside and a twelve sided polygon inside the centerpiece hex sleeve disposed inside the hollow center sleeve for receiving a workpiece, e) a manual spinner attached securely to the centerpiece hex sleeve for rotating the centerpiece hex sleeve by hand, f) spring means positioned within the housing back end and contiguous with the sleeve groove, said spring means urge a sleeve gear into a housing gear for engagement such that the gears mesh in one rotational direction and slide apart and rotate freely when rotated in an opposite direction, g) switching means within the housing back end for transposing direction of the spring means from engagement of one set of housing gears and sleeve gears to another thus, changing rotational direction of the socket wrench when operatively engaging a workpiece, and h) a handle with a knuckle protector disposed on the back end of the ratchet housing for gripping the wrench and for protection of an operator's knuckles during functional operation of the wrench.

4. The socket wrench as recited in claim 3 wherein said cover plate gear, lower housing gear and sleeve male gears further comprise a tooth angle of from 25 to 30 degrees and a back slope of from 2 to 4 degrees providing a non-slip interface when the gears intermesh.

5. The socket wrench as recited in claim 3 wherein said hollow within the center sleeve is polygonal with six sides.

6. The socket wrench as recited in claim 3 further comprising a socket having an external shape to mate with the twelve sides within the centerpiece and an internal shape mating with a workpiece.

7. The socket wrench as recited in claim 3 wherein said spring means further comprises:

a) a rocking log pivotally disposed within an opening in the ratchet housing said log further having a cavity with through bores, b) a rocking log pin extending from the leg in an upward direction, and c) a U-shaped wire form spring disposed within the log cavity and through bores, said spring having a cylindrical piece on each end with the cylindrical pieces interfacing with the center sleeve groove such that when the log pin is urged linearly by the switching means the log rotates bending the spring and urging the center sleeve gears into contact with the housing gears constantly maintaining spring tension to assure complete meshing while yet allowing the sleeve to ratchet in an opposite direction under resistance of the spring.

8. The socket wrench as recited in claim 7 wherein said switching means further comprises:

a) a direction slide switch bar having a thumb grip on one end and a countersunk cavity on the other with a pair of pin receiving holes adjacent to the cavity, b) said second end of ratchet and handle having an extended slot for receiving the switch bar slide therein, and c) a switching detent having a detent spring and pressure ball, the detent retained within the ratchet housing, said rocking log pin penetrating the countersunk cavity in the switch bar and the detent urging the ball into one of the holes such that when the thumb grip is slid within the slot, the ball is pushed from one hole to another simultaneously rotating the log and changing angle of direction of the wire form spring and rotational direction of the wrench.

9. The socket wrench as recited in claim 3 wherein said handle further comprises:

a) a handle extension attached to the back end of the housing, and b) a grip having a knuckle guard and a thumb rest integrally formed therewith, affixed onto the handle extension.

10. The socket wrench as recited in claim 9 wherein said knuckle guard is removable.

* * * * *